United States Patent [19]

Enge

[11] 4,063,098

[45] Dec. 13, 1977

[54] BEAM SCANNING SYSTEM

[75] Inventor: Harald A. Enge, Winchester, Mass.

[73] Assignee: Industrial Coils, Inc., Middleton, Mass.

[21] Appl. No.: 730,436

[22] Filed: Oct. 7, 1976

[51] Int. Cl.[2] ..... G21R 1/08

[52] U.S. Cl. ..... 250/396 R; 250/398

[58] Field of Search ..... 250/396, 398

[56] References Cited

U.S. PATENT DOCUMENTS

| | | | |
|---|---|---|---|
| 2,866,902 | 12/1958 | Nygard | 250/396 |
| 3,193,717 | 7/1965 | Nunan | 250/400 |
| 3,405,363 | 10/1968 | Brown | 250/396 |

*Primary Examiner*—Harold A. Dixon

*Attorney, Agent, or Firm*—Robert F. O'Connell

[57] ABSTRACT

A system for deflecting a beam of particles having different momenta, preferably through a 90° angle, so as to cause the beam to impinge upon a moving target and to scan across the target. The system includes a means responsive to a beam from a suitable source for causing the beam to periodically scan in a scanning plane and further means for deflecting the periodically scanned beam through the desired angle in a deflection plane so that the deflected beam impinges on the target. Means are included in the system for reducing the momentum dispersion at the target in both the deflection and the scanning planes and for spatially focussing the beam so as to produce a desired beam diameter at the target.

13 Claims, 9 Drawing Figures

BEAM SCANNING SYSTEM

INTRODUCTION

This invention relates to beam scanning systems and, more particularly, to systems for causing a beam of charged particles to be deflected through a predetermined angle to a target over which said beam is periodically scanned.

BACKGROUND OF THE INVENTION

In many applications it is desirable to utilize beams of charged particles which impinge upon materials in the processing thereof. For example, electron beams of relatively high intensity are often used to irradiate medical instruments and materials for sterilization purposes. Further, beams of ions or electrons are often used to impinge upon plastic materials in the processing thereof, as for polymerizing such materials. For example, electron beams having energies typically in the range of hundreds of keV up to as high as 10 MeV, or thereabouts, are used for such sterilization or polymerization irradiation. The beams which are used may often have a momentum spectrum with a width typically of about ± 10 percent.

In such systems, for example, the beam of charged particles may be obtained from a linear accelerator which produces a beam having substantially parallel rays of such particles and which is usually mounted so as to produce a horizontally oriented beam. The material which is to be irradiated is generally moving along a horizontal conveyor belt so that the irradiation beam from the accelerator must be deflected from its horizontal orientation to a vertical orientation, while at the same time the beam is moved back and forth, or scanned, in a periodic manner so that it scans the conveyor and, hence, the material placed thereon.

Because the particles contained in the beam have different momenta, they are deflected at different angles as they pass from the horizontal to the vertical direction. Accordingly, when the particles reach the conveyor target, they are dispersed in proportion to their momenta, and it is necessary to compensate in some manner for such momentum dispersion in order to limit the size of the metal-foil window through which the beam is emerging from the vacuum system into the air.

Further, when the beam is scanned and moved periodically back and forth in the scanning plane, additional dispersion of the particles occurs since the higher momentum particles are scanned less (i.e., through a smaller scan angle) than the lower momentum particles, and means must be provided for causing the particles to be scanned over a scanning amplitude which is substantially the same for all momenta.

Moreover, the diameter of the beam (i.e., the beam spot size or spatial focussing thereof) at the target must be appropriately adjusted to provide for suitable overlap of the scanning paths as the conveyor and the target materials move thereunder. Thus, if the spot size is too small, sufficient overlap cannot be obtained, while if it is too large, the zones of diminishing average intensity become too wide along the edges of the conveyor belt at the ends of the scan amplitude. Accordingly means must be provided for appropriately adjusting the beam size at the target plane.

Moreover, the means for providing dispersion and beam size adjustment and compensation must be appropriately compatible so that their interactions produce the desired overall beam deflection, scanning and spot size characteristics, even when the distance between the beam control system and the target at the conveyor varies.

One approach to the problem which has been offered in the prior art is discussed in U.S. Pat. No. 3,193,717 issued to C. S. Nunan on July 6, 1965. In the Nunan system a deflecting magnet has an edge which is contained in a rotatable section for changing the angle of inclination between the particle beam and the magnet to change the trajectories of particles of different energies through the same angle. The deflection magnet is followed by a scanning magnet whose pole faces have a magnetic field gradient therebetween to deflect all the particles of a particle beam with a particle energy gradient through approximately the same angle. A quadrupole magnet is provided ahead of the deflecting magnet to adjust the size of the irradiating spot of particles at the target.

Because Nunan provides for scanning to take place after deflection of the beam a relatively large scanning magnet is required in order to provide a sufficiently wise scan path at the target. Moreover, the scan magnet has a complex configuration since it is also used to correct for dispersion effects of the beam in the scanning plane due to the deflection thereof by the deflecting magnet. Dispersion correction in the deflecting plane is taken care of by adjusting the exit angle of the beam at the output of the deflection magnet. However, since the configuration of the deflection magnet places a physical limit on the size of such angle, complete correction for deflecting plane dispersion at the target cannot be achieved without undesirable difficulty. Because of the inability to completely correct for deflecting plane dispersion the size of the output window through which the particles pass from the deflection/scanning system to the target is larger than would be required if complete correction is made. Because the window must withstand a required amount of pressure it cannot be made too large or else it will be subject to possible breakage during operation.

Hence, a more effective and less costly design to overcome the deficiencies of the Nunan system is desired.

BRIEF SUMMARY OF THE INVENTION

In accordance with the invention an input particle beam, as produced by a linear accelerator, for example, travels in a direction substantially parallel to a conveyor means on which objects to be irradiated therewith are placed, e.g., in a substantially horizontal direction. A deflection means is provided for producing a substantially 90° deflection of the beam so that it is thereupon directed downwardly onto the conveyor target, e.g., in a substantially vertical direction. Such means can be in the form of an appropriately configured dipole deflection magnet. The dispersion of the beam particles which is produced by such deflection process is suitably compensated for by utilizing a quadrupole magnet near the exit end of the deflection dipole magnet so as to provide appropriate focusing of the high and low momentum particles in the deflection plane, i.e., the dispersive plane of the dipole, so that such dispersion is substantially completely eliminated at the position of the conveyor target.

The beam is appropriately scanned by providing for a scanning magnet at the input side of the deflection dipole magnet between the latter magnet and the beam source. The quadrupole magnet a the exit end of the deflecting magent is oriented so as to provide focusing action in the deflection plane and, accordingly, is providing a defocusing action in the scanning plane. Hence, the angles defining the fanned out beam energizing from the scanner are substantially enhanced by the defocusing action of the quadrupole magnet and the scanning angle at the scanning magnet can be made relatively smaller than if such scanning magent is placed at the exit end of the system, as in the Nunan apparatus. The size and cost of the scanning magnet is thereby considerably reduced in comparison with that of Nunan.

The scanning process introduces a dispersion of the particles in the scanning plane in that the higher momentum particles are scanned through angles which are less than those of the lower momentum particles. This scanning dispersion effect is compensated for by making the quadrupole configuration asymmetric, i.e., by appropriately designing the configuration of the poles so that a narrower gap occurs between those poles through which the higher momentum particles pass than occurs between the poles through which the lower momentum particles pass. Such configuration, in effect, introduces a sextupole component into the quadrupole element in addition to the dominant quadrupole component. The main result of this asymmetry is to produce a stronger defocusing effect on the side where the higher momentum particles are traveling than on the other side thereby compensating for the dispersion effect which has occurred in the scanning process.

In the system, the scanning magnet current can be adjusted to provide the desired scanning amplitude at the conveyor target and the dipole current of the deflection dipole magnet can be adjusted to provide the desired 90° deflection of the particle beam. The strength of the quadrupole component can be adjusted to provide a non-dispersive beam in the deflection plane at the conveyor target and the strength of the sextupole component can be adjusted to provide a correction for beam dispersion due to the scanning effect in the scanning plane.

target can be adjusted by an appropriate design of the entrance and exit angles of the deflection magnet in order to provide one or more beam "waists" at appropriate locations to produce the desired spot size at the conveyor. Thus, in a particular embodiment where the target is approximately 100 cm. from the quadrupole magnet, a beam waist in the deflection and the scanning planes substantially at or near the center of the quadrupole magnet will result in an appropriate beam spot size. The quadrupole magnet action will accordingly have substantially little focusing or defocusing effect on the spot size. If the conveyor target is at a longer distance an additional pair of input quadrupole magnets can be positioned in the beam path ahead of the scanning magent, the combined action of this quadrupole doublet, the deflection magnet and the single output quadrupole magnet thereby being adjusted to provide waist positions and angles of conveyence appropriate for producing a reasonable spot size at the conveyor target.

DESCRIPTION OF THE INVENTION

Preferred embodiments of the invention are described in more detail with the help of the accompanying drawings wherein.

Figure 1:
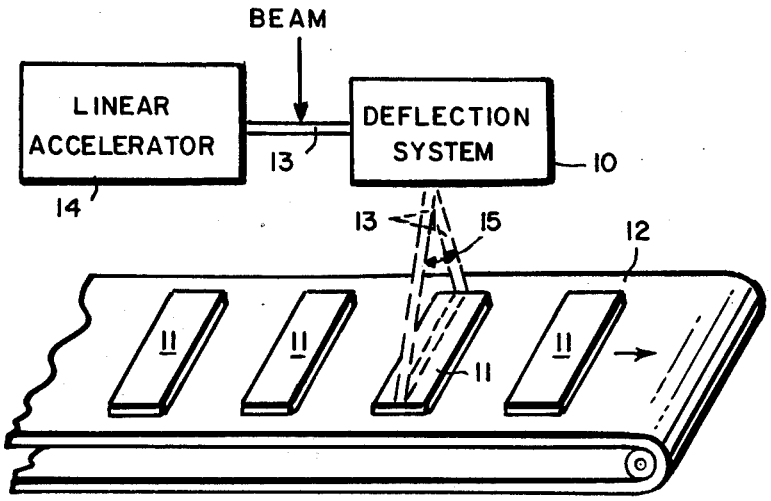
FIG. 1 shows a partial block and partial perspective diagrammatic view of an overall system in which the invention can be used.

As can be seen in FIG. 1, one application in which the deflection system 10 of the invention can be effectively used is in a beam scanning system wherein a plurality of articles 11 are travelling on a conveyor means 12 in the direction of the arrow placed thereon, for example. Such articles are to be irradiated by a beam of charged particles shown by a scanning beam 13 produced from deflection system 10. The source of beam 13 is, for example, a linear accelerator 14 which supplies beam 13 to the input of deflection system 10. As the particles 11 move under beam 13, the latter is periodically moved through an angle 15 so as to scan across articles 11 as they move thereunder. Thus, deflection system 10 must cause the beam 13 to be deflected through an angle of approximately 90° so as to be directed downwardly upon the conveyor target plane and simultaneously to cause said beam to move periodically back and forth thereacross to produce the scanning action. Moreover, the beam deflection system must be arranged so that the size (diameter) of the beam can be controlled so that, when it impinges upon the articles it has a selected size which is sufficiently large to permit an appropriate overlapping of the scanning paths as the articles are moved thereunder and small enough to produce a sufficient intensity of irradiation on the article even at the farthest edges of the scanning path at the conveyor.

Figure 2:
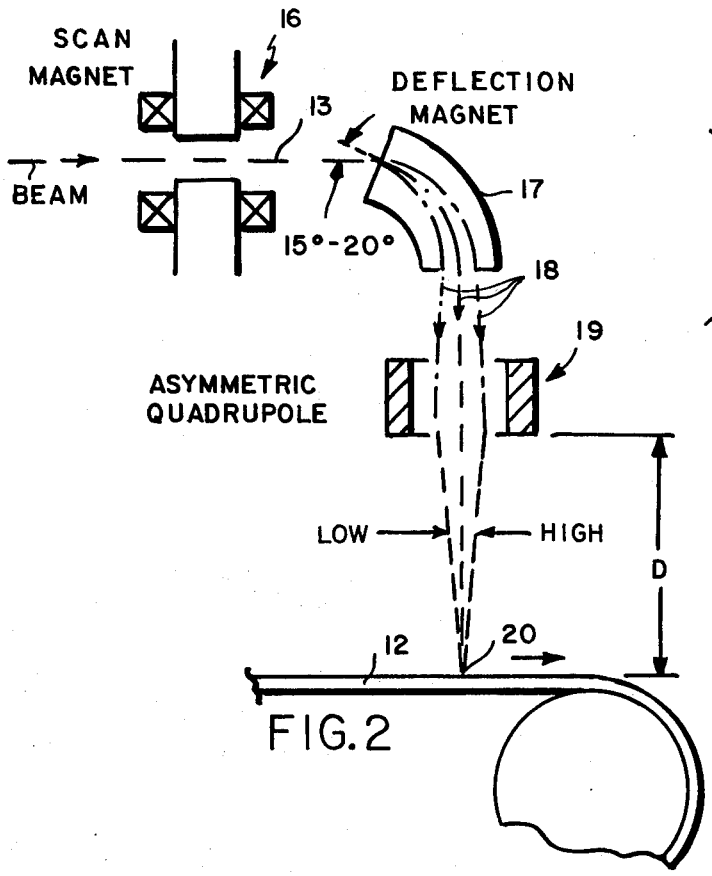
FIG. 2 shows a diagrammatic view of the scanning and deflection system of one embodiment of the invention for providing a 90° beam deflection.

FIG. 2 shows in diagrammatic form a more detailed drawing of the deflection system 10 of FIG. 1 in accordance with the invention. As seen therein, beam 13, which, for clarity, is shown as a single ray at the input end of FIG. 2 passes through the poles of a scanning magnet 16 which creates a periodically varying magnetic field which causes the beam to scan back and forth therebetween in a plane perpendicular to the plane of the paper. The scanning effect is discussed in more detail with respect to FIG. 3. The beam which is so scanned is thereupon deflected through an angle of substantially 90° by deflection magnet 17, the beam thereupon being conveyed downwardly in the vertical direction toward conveyor means 12 as shown by arrows 18. The beam passes through an asymmetric quadrupole magnet 19, the structure of which is discussed in more detail below.

The beam of charged particles is not mono-energetic and, for this reason, contains particles having different energy, or momenta. If the momentum spectrum of the beam is expressed as $\Delta p/p$, were p is the total momenta of the beam, such expression effectively defines the momentum spectrum width. Thus, in a typical system in which the invention is to be used, the beam may have a spectrum width of $\pm 15\%$, i.e.,$\Delta p/p = \pm 0.15$. If such a beam is passed through dipole deflection magnet 17 and is thereupon deflected through substantially 90°, the beam will tend to spread out or disperse in the deflection plane (i.e., the plane of the drawing), as shown by the dashed line dispersion at the output (at 18) thereof, as well as in the scanning plane (not shown) perpendicular thereto, since the lower momenta particles will be deflected to a greater extent than the higher momenta particles. In order to produce a substantially non-dispersive beam in the deflection plane at the target area, i.e., at the plane of the conveyor means, an appropriate quadruple magnet 19 is utilized to re-focus the beam in the median plane in the conventional way by first-order beam optics (as shown in FIG. 2). Were the dispersion in the deflection plane caused by the deflection magnet the only dispersion problem, the presence of a conventional symmetric quadrupole magnet would provided the desired focussing effect of the dispersed beam in the deflecting plane so that the higher and lower momenta particles are all caused to impinge upon the conveyor at substantially the same point 20.

In providing for an appropriate scanning of the beam, however, scan magnet 16 causes the beam to scan in a first plane substantially perpendicular to the plane of the drawings at the scan magnet region. Such scanning is accomplished by supplying an appropriate time varying current through the coils of the magnet as, for example, current having a triangular wave shape. Deflection through the 90° path thereupon causes the scanned beam to scan in a second scan plane, substantially perpendicular to the first scan plane, also in a direction perpendicular to the plane of the drawing, so that the focal point 20 of the high and low momenta particles scans across the conveyor means as shown in FIG. 1.

Figure 3:
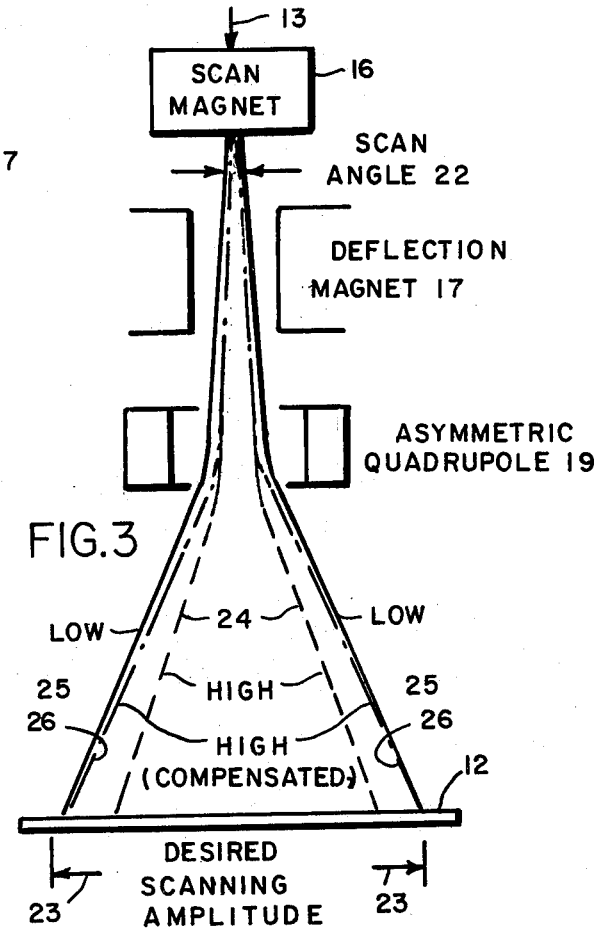
FIG. 3 shows a diagrammatic view of the embodiment of FIG. 2 showing the scanning operation of the system of the invention.

However, the scanning process itself also causes a further description of the beam particles in the scanning plane since the higher momenta particles will tend to scan over a path which is less than that scanned by the lower momenta particles. FIG. 3 shows the effect on the particle dispersion of the scanning operation. For clarity, the drawing of FIG. 3 shows a "folded out" version of the system where the scan magnet 16, the deflection magnet 17, and the quadrupole magnet 19 are essentially shown in-line so that the scanning dispersion problem is better understood. In FIG. 3 the view is substantially orthogonal to the view of FIG. 2 at the conveyor means 12 so that the latter is moving toward the viewer perpendicular to the drawing. Thus, the beam is scanned over a scanning amplitude which, as shown by the arrows 23 is in a lateral direction on conveyor means 12.

The scanning means is in the form of an electromagnet means which has a varying magnetic field generated by the application of an alternating current to the coils whereof, as mentioned above. The varying magnetic field causes the input beam 13 which enters the scanning magnet to periodically move, or scan, through a scan angle 22 as shown. The scanning beam is appropriately deflected through a substantially 90° angle in the manner shown in FIG. 2 by deflection magnet 17. Th beam exits from the deflection magnet and passes through the quadrupole magnet 19 which further deflects the beam to increase the scan angle to provide the appropriate lateral scanning amplitude at the target area of the conveyor 12. Because the beam is non-monoenergetic, the higher energy particles, having higher momenta, are delfected less than the lower energy particles, having lower momenta, as shown by dashed lines 24 for exemplary higher momenta particles and solid lines 25 for exemplary lower momentum particles. In order to avoid the dispersion thereof at the target area in the lateral direction of the conveyor which results, the quadrupole magnet 19 is especially arranged to be asymmetric in its configuration so that the higher momenta particles which pass therethrough are deflected (as shown by dash-dot lines 26) by substantially the same amout at the target plane as the lower momenta particles and all of the particles tend to focus at substantially the same position throughout the entire scan.

Figure 4:
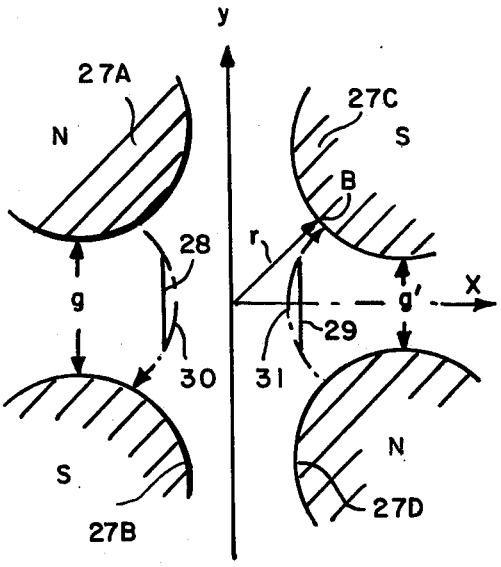
FIG. 4 shows a diagrammatic view of the asymmetric quadrupole element of FIGS. 2 and 3.

A portion of such an asymmetric quadrupole magnet is shown in diagrammatic form in FIG. 4 wherein the four poles 27A–27D thereof are arranged so that the gap g between poles 27A and 27B through which the lower momentum particles, symbolically shown by line 28, pass in greater than the gap $g'$ between poles 27C and 27D through which the higher momentum particles, symbolically shown by the line 29, pass. The different gap distances produce an asymmetry so that the field strength of the overall quadrupole magnet (which for a conventional symmetric quadrupole magnet has only a quadrupole component) has both a quadrupole component and a sextupole component.

As can be seen in FIG. 4, two magnetic field lines 30 and 31 are indicated therein with respect to magnets 27A, 27B and 27C, 27D, respectively. Because of the asymmetry of the quadrupole magnet the $x$-components of the fields at the ends of the scan for the higher momenta particles, represented by line 29, are stronger than the $x$-components at the ends of the scan for the lower momenta particles, represented by the line 28. These components produce the stronger $y$-deflection for the higher momenta particles 29 of the beam.

The desired magnetic field configuration produced by such an asymmetry can be shown to be of a form having a quadrupole component and a sextupole component, i.e., a sextupole field superimposed upon the quadrupole field. Accordingly, the scalar magnetic potential can be expressed as:

$$\phi = \tfrac{1}{2}\, Gr^2 \sin 2\theta + \tfrac{1}{3}\, Hr^3 \sin 3\theta$$

where $r=(x^2+y^2)^{1/2}$, $\tan\theta = y/x$, G is the quadrupole field gradient (Gauss/cm) and H is a sextupole field coefficient (Gauss/cm$^2$). The field components $B_x$ and $B_y$ are found by partial differentiation:$B_x = -\delta\phi/\delta x$ and $B_y = -\delta\phi/\delta y$.

The ratio of the sextupole coefficient H to the quadrupole field strength G which gives correct dispersion cancellation of the scanning amplitude can be calculated by trial and error using well-known beam optical computer techniques as described, for example, with reference to the "Transport" computer program developed at the Stanford Linear Accelerator Center (SLAC), Stanford, California and described in SLAC Report 91 on The Transport/360 program, readily available to those in the field.

When G and H are thus determined, the desired shapes of the poles of the device are found by solving the equation for $\phi$ to give $r$ as a function of $\theta$ (i.e. $r=f(\theta)$) for appropriately chosen fixed values of $\phi$, i.e., the values (plus and minus) that $\phi$ should have at the surfaces of the north and south poles. These fixed values of $\phi$ must be appropriately chosen to give sufficient free space between the pole for the particles. It has been found that the pole shapes can be suitably approximated by circles as shown diagrammatically in FIG. 4 and the quadrupole magnet constructed accordingly.

While the asymmetry which results in superposition of a sextupole component on the quadrupole component in the quadrupole magnet produces the desired compensation for the scanning dispersion effects, such asymmetry also produces a beam which tends to scan across the target in a slight arc rather than in an exact straight line. Such slight departure from a straight line, however, produces no adverse effects in use for scanning the target and can be tolerated in substantially all practical uses for the invention.

While the input beam to the scanning magnet from the linear accelerator is shown above by a single line (i.e., an effective zero diameter), in actuality the beam is made up of a plurality of substantially parallel, or nearly parallel, rays of particles so that the overall beam has a particular non-zero diameter as it leaves the source. If no radial focusing or defocusing thereof occurs throughout the system, the beam would produce a corresponding beam spot size at the target on which it impinges. Typically, for example, the beam from the linear accelerator may be of the order of 6–7 millimeters in diameter.

As the beam travels through the system the focusing properties of the three elements produce substantial changes in the beam diameter. A 90° deflecting magnet always has a net focusing effect and can, for instance, produce stigmatic imaging by appropriate adjustments of the entrance and exit angles. In the embodiment shown in FIG. 2 the angles have been chosen to produce a beam "waist" (minimum diameter) in the deflecting plane substantially in the vicinity of the asymmetric quadrupole magnet 19 and a waist (extrapolated) at a point beyond the quadrupole in the scanning plane. In a typical use for which one speicifc embodiment of the invention was designed, the distance D (See FIG. 2) from the quadrupole magnet 19 to the conveyor 12 was about 100 centimeters and the radius of the deflecting magnet was 15cm. It was found in such embodiment that provision of a beam waists in the general regions at and beyond the asymmetric quadrupole magnet as explained above causes an appropriate increase of the beam diameter from such region to the target conveyor producing a spot size, at the target, of a desired value, which in a typical application, for example, may be approximately 3–4 centimeters. Focussing of the beam to produce a waist in the desired region of the quadrupole magnet can be achieved by adjusting both the entrance and the exit angles at the deflection magnet 17 over a reasonable range. For the typical embodiment discussed above, wherein the quadrupole magnet is about 100 centimeters from the target conveyor, the entrance angle of the deflection magnet is between 15°–20° and the exit angle is 0° (diagrammatically shown in FIG. 2) and the desired beam waists in the general vicinity of the quadrupole magnet are produced, as shown in FIG. 8.

Figure 8:
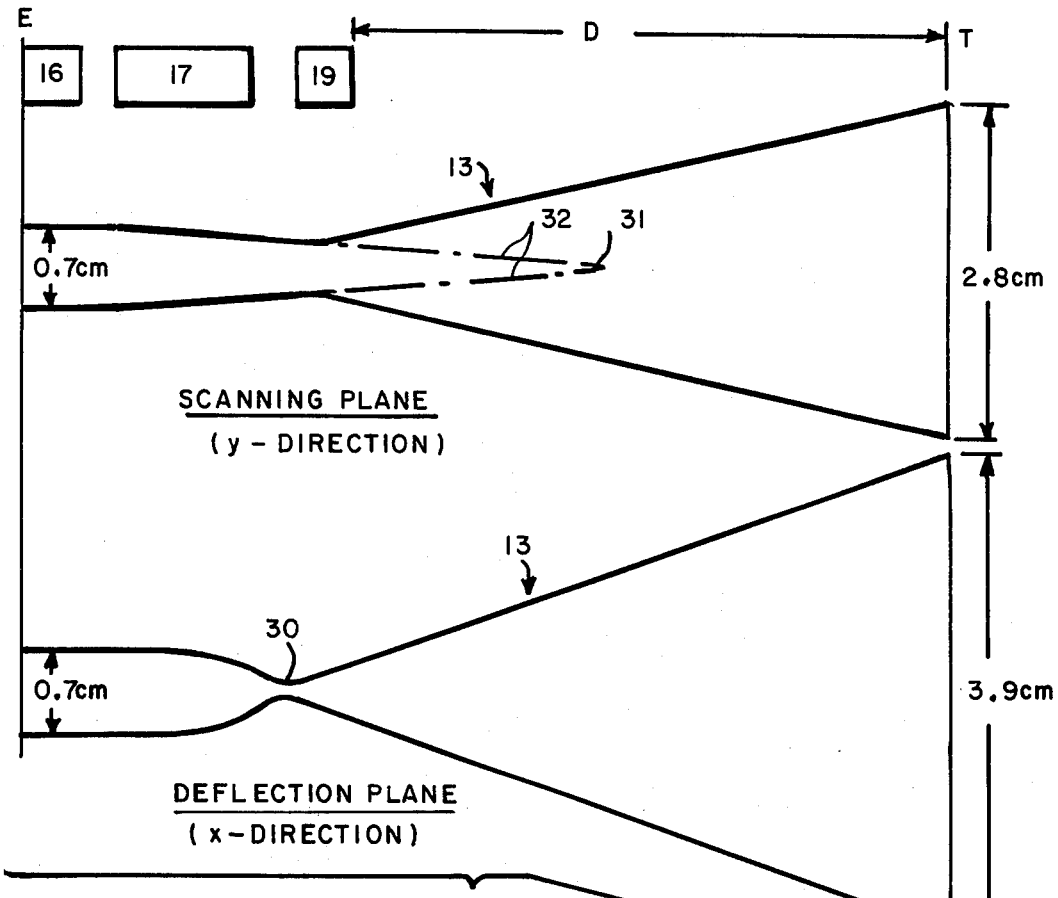
FIG. 8 shows a diagrammatic view of the invention which depicts the spatial focussing of the beam therein in the deflection and scanning planes in accordance with the embodiment of FIGS. 2 and 5.

Thus, in FIG. 8 the scanning magnet 16, deflection magnet 17 and quadrupole magnet 19 are shown diagrammatically by the numbered blocks in a "folded-out" path to provide a total beam path for beam 13 from the entrance region of scanning magnet 16 (point E) to the target conveyor 12 (point T) of about 155 cm., the distance D from the exit region of the quadrupole magnet to the target being about 100 cm. The variation in beam spot size is shown from the input to the target without scanning and, as seen therein, has a diameter as received from the linear accelerator at the input to the scan magnet 16 of about 0.7 cm. in both the scanning plane (the Y direction) and in the deflection plane (the X direction). A beam waist 30 due to the deflection magnet occurs in the deflecting plane at the region just prior to the quadrupole magnet 19 at which region the beam diameter, for example, may be about 0.1 cm depending upon the divergence of the incident beam. The action of the quadrupole tends to reduce the divergence somewhat from that region to the target, where it produces a beam diameter of about 3.9 cm. In the scanning plane after the deflecting magnet the beam would normally converge to a waist at a region 31 beyond the quadrupole magnet as shown by the dashed lines 32. The action of the quadrupole, however, prevents the formation of a real waist and the beam diverges from the quadrupole to form a beam diameter of about 2.8 cm. at the target.

Figure 5:
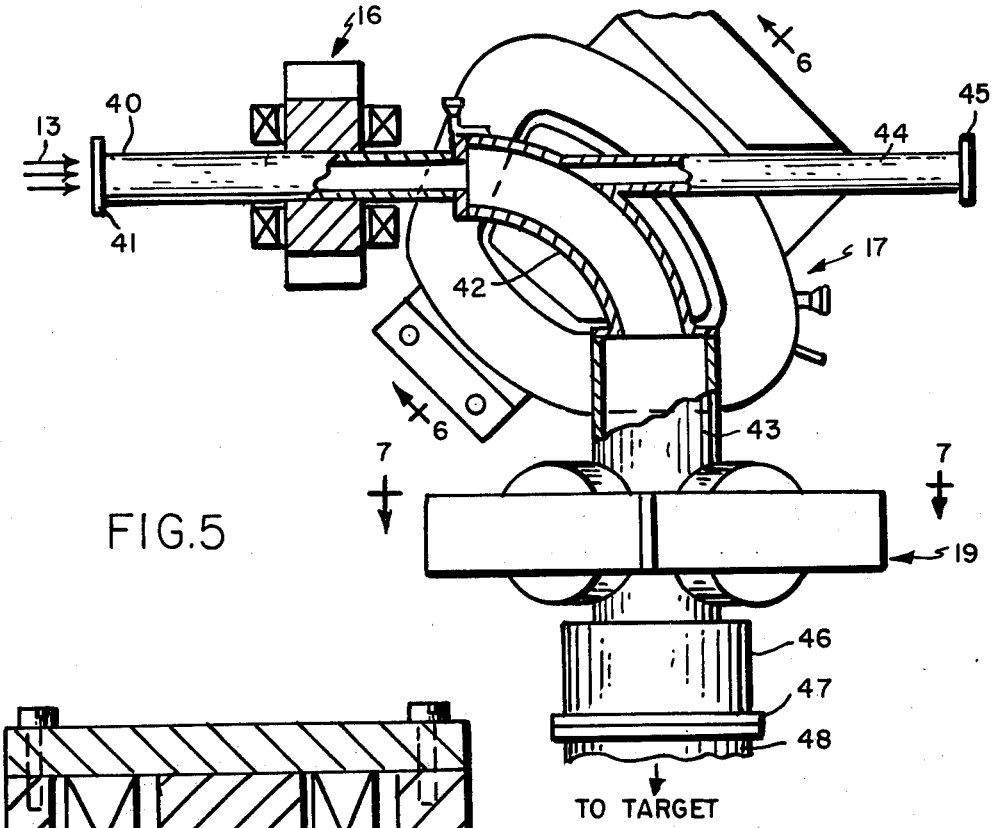
FIG. 5 shows a more detailed view in section of a specific embodiment of the invention shown in FIG. 2.
Figure 6:
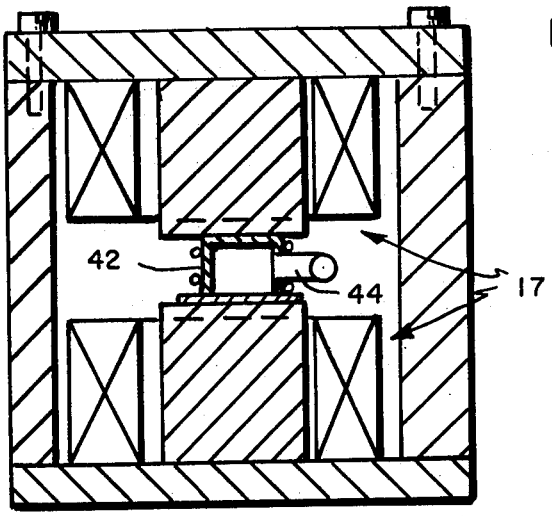
FIG. 6 shows a section view taken along the lines 6—6 of the embodiment of FIG. 5.
Figure 7:
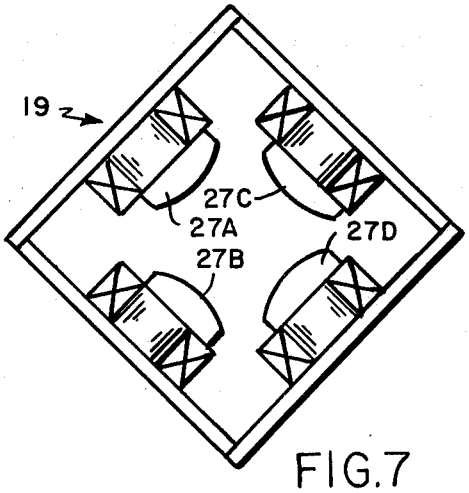
FIG. 7 shows a section view taken along the lines 7—7 of the embodiment of FIG. 5.

FIGS. 5–7 show more detailed descriptions of a specific embodiment of the invention for use in the system of FIGS. 2 and 8 wherein the distance from the quadrupole magnet 19 to the target conveyor is approximately 100 cm. As seen therein, the input beam 13 from a linear accelerator (not shown) is coupled to an evacuated rectangular chamber 40 via flange 41. The dimension of chamber 40 is sufficient to accommodate the beam as it is defelected by the scanning magnet 16.

Scanning maget 16 is positioned as shown adjacent and external to chamber 40 and a time-varying current applied to the coils thereof causes the beam to be deflected in a scanning plane (i.e., perpendicular to the plane of the drawing) over a selected scanning angle, as discussed with reference to FIG. 3. The scanning beam thereupon enters extended rectangular chamber 42 and passes between deflection magnet 17 appropriately mounted adjacent chamber 42 as shown. When deflection magnet 17 is operating, the beam is thereupon deflected through a substantially 90° angle in the deflecting plane (i.e., in the plane of the drawing) to emerge from chamber 42 into further extended cylindrical chamber 43. When the deflection magnet is not operating the beam will pass through tubular extension 44 and out through flange 45.

In chamber 43 the beam passes through asymmetric quadrupole magnet 19 and from there enters rectangular chamber 46 which is coupled by flange 47 to a flared rectangular chamber 48 (only partially shown) of the general type shown by flared section 16 of the aforementioned Nunan patent. The flare thereof is in the scanning plane and the scanning beam exits from the flared chamber at a suitable metal foil exit window just above the target conveyor, as shown diagrammatically in FIG. 1.

If the distance from the exit of quadrupole magnet 19 to the target conveyor is greater than about 100 cm. further control of the beam spot size may be required so that the divergence of the beam does not provide too large a beam diameter at the target. Such control can be achieved by utilizing a pair of conventional symmetric quadrupole magnets 33 and 34 positioned at the input of the system between the linear accelerator and the scanning magnet, as shown diagrammatically by the numbered blocks in FIG. 9. Such quadrupoles provide appropriate focussing in the deflection and scanning planes, respectively, by appropriate control of the input currents thereto. When the distance from the quadrupole magnet 19 to the target is greater than about 100 cm. the input pair of quadrupole magnets is controlled to provide beam waists in the deflection and scanning planes at suitable locations along the path to produce a reasonable spot size at the target conveyor.

Figure 9:
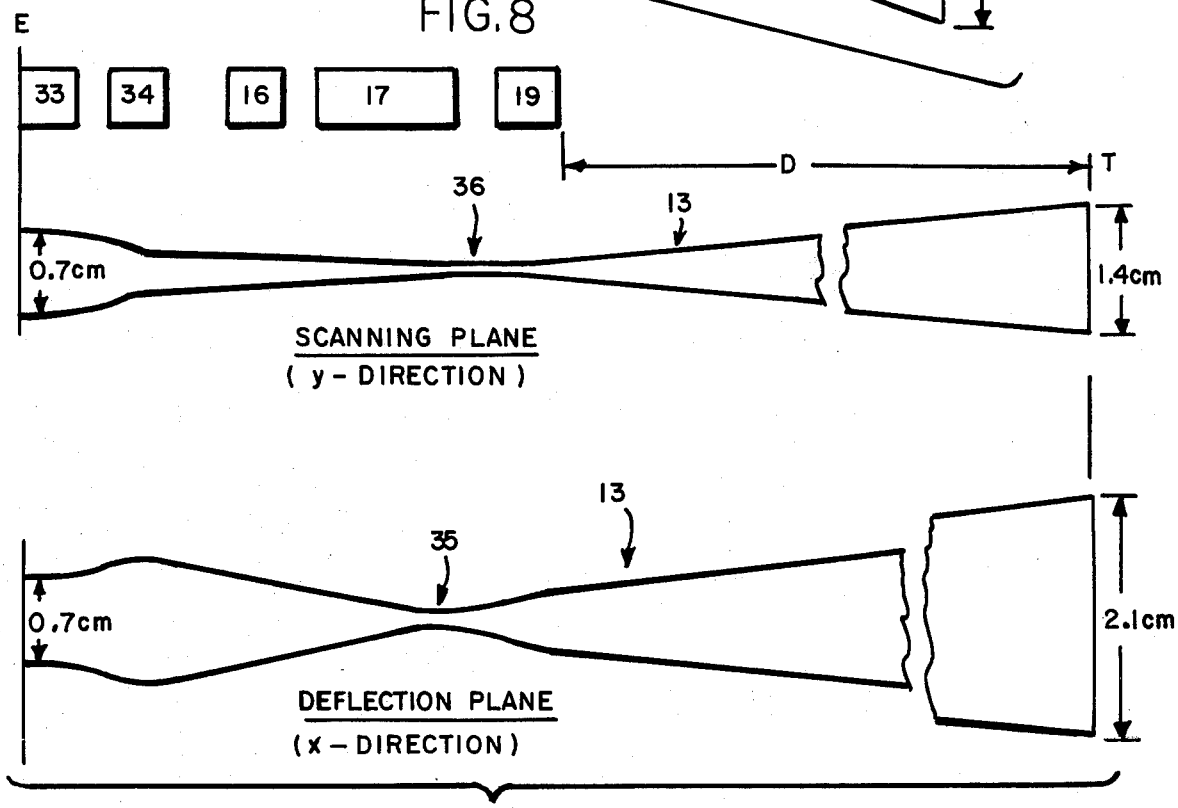
FIG. 9 shows a diagrammatic view of an alternate embodiment of the invention which depicts the spatial focussing of the beam therein in the deflection and scanning planes.

Such a system is shown diagrammatically in FIG. 9 wherein input quadrupole magnets 33 and 34 of conventional symmetric configuration are positioned ahead of scanning magnet 16. The overall distance from the entrance point E at quadrupole magnet 33 to the target point T is about 390 cm. and the distance D from the exit of quadrupole magnet 19 is about 300 cm. A beam waist 35 is formed in the deflecting plane just before the exit of the beam from deflection magnet 17 and a beam waist 36 is formed in the scanning plane approximately between the deflection magnet 17 and output quadrupole magnet 19. In the deflecting plane the operation is similar to that in FIG. 8 except that the angle of convergence to the waist 35 is smaller and the beam amplitude at the output quadrupole 19 is larger. Overall, this operation produces a smaller divergence after quadrupole magnet 19 and a reasonable spot size of about 2.1 cm. at the target. In the scanning plane the beam waist 36 is so close to the quardrupole magnet 19 that the asymmetric quadrupole action has relatively little effect on the beam diameter. The angle of convergence toward the waist 36 in the scanning plane is relatively small and, therefore, the angle of divergence is also small to produce a beam diameter of about 1.4 cm. at the target. It is within the skill of the art to adjust the currents to the input quadrupoles 33 and 34 and the entrance and exit angles of the deflection magnet 17 to provide for an appropriate beam spot size at the target, as would be required in any particular application of the system of the invention for whatever distance exists between the output at the symmetric quadrupole magnet 19 and the target conveyor.

What is claimed is:

1. A system for deflecting an input beam of charged particles having a spread of momenta from a source thereof to cause said beam to impinge on a target having a predetermined spatial relationship with said source, said system comprising means responsive to said input beam for periodically scanning said beam in a scanning plane;

means responsive to said periodically scanned beam for deflecting said periodically scanned beam through preselected angle in a deflection plane, the said scanning plane subsequent to said deflection being angularly oriented with respect to said scanning plane prior to said deflection, said deflected and periodically scanned beam being thereupon directed to impinge upon said target plane; and means for substantially reducing the momentum dispersion of said beam in the deflection plane at said target due to the deflection thereof by said deflecting means and for substantially reducing the momentum dispersion of said beam in the scanning plane at said target due to the periodic scanning movement thereof by said beam scanning means.

2. A system in accordance with claim 1 and further including means for spatially focusing said beam to produce a beam diameter of a predetermined size at said target.

3. A system in accordance with claim 1 wherein said deflection and scanning dispersion reducing means includes a quadrupole magnet positioned in the path of said beam following said deflecting means.

4. A system in accordance with claim 3 wherein said quadrupole magnet has an asymmetric configuration for reducing the dispersion of said beam in the scanning plane due to the scanning movement thereof.

5. A system in accordance with claim 4 wherein the asymmetry of said quadrupole magnet is arranged to provide a first magnetic field strength in the scanning plane of said beam for deflecting the particles of said beam having lower momenta and a second magnetic field strength in the scanning plane of said beam for deflecting the particles of said beam having higher momenta, thereby reducing the dispersion of the beam in the scanning plane at said target.

6. A system in accordance with claim 5 wherein the asymmetry of said quadrupole magnet is arranged to provide an effective sextupole component of magnetic field strength for reducing the dispersion in said scanning plane superimposed on the quadrupole component of magnetic field strength which reduces dispersion in the deflecting plane.

7. A system in accordance with claim 6 wherein said deflection means is a dipole magnet.

8. A system in accordance with claim 2 wherein said deflection and scanning dispersion reducing means includes a quadrupole magnet positioned in the path of said beam following said deflecting means.

9. A system in accordance with claim 8 wherein said quadrupole magnet has an asymmetric configuration for reducing the dispersion of said beam in the scanning plane due to the scanning movement thereof.

10. A system in accordance with claim 9 wherein the assymmetry of said quadrupole magnet is arranged to provide a first magnetic field strength in the scanning plane of said beam for deflecting the particles of said beam having lower momenta and a second magnetic field strength in the scanning plane of said beam for deflecting the particles of said beam having higher momenta, thereby reducing the dispersion of the beam in the scanning plane at said target.

11. A system in accordance with claim 10 wherein the asymmetry of said quadrupole magnet is arranged to provide an effective sextupole component of magnetic field strength for reducing the dispersion in said scanning plane superimposed on the quadrupole component of magnetic field strength which reduces dispersion in the deflecting plane.

12. A system in accordance with claim 11 wherein said deflection means is a dipole magnet and said spatial focusing means includes the arrangement of the entrance and exit angles of said deflection dipole magnet for producing desirable focusing effects on said beam in the deflection plane and the scanning plane thereof.

13. A system in accordance with claim 12 wherein said spatial focusing means further includes a pair of quadrupole magnets positioned in the path of said beam ahead of said beam scanning means, the magnetic field strengths of each of said quadrupole magnets being selected to produce focusing effects on said beam in the deflection plane and the scanning plane thereof.

* * * * *

UNITED STATES PATENT AND TRADEMARK OFFICE

CERTIFICATE OF CORRECTION

PATENT NO. : 4,063,098

DATED : December 13, 1977

INVENTOR(S) : Harald A. Enge

It is certified that error appears in the above-identified patent and that said Letters Patent are hereby corrected as shown below:

Title Page, line [73], change the Assignee to:

---Haimson Research Corporation, Palo Alto, Calif. --

Column 3, line 42, before "target", please insert

---Further, the size of the particle beam spot at the---.

Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*